United States Patent [19]

Halley, Jr.

[11] 4,002,119

[45] * Jan. 11, 1977

[54] METHOD FOR IN SITU ASSEMBLY OF CHARGE FOR CONTROLLED SHOOTING OF WELLS

[75] Inventor: Henry H. Halley, Jr., Alton, Ill.

[73] Assignee: Drogen Incorporated, Alton, Ill.

[ * ] Notice: The portion of the term of this patent subsequent to Oct. 9, 1990, has been disclaimed.

[22] Filed: July 16, 1973

[21] Appl. No.: 379,642

Related U.S. Application Data

[63] Continuation-in-part of Ser. No. 56,438, July 20, 1970, Pat. No. 3,763,781.

[52] U.S. Cl. ..... 102/21

[51] Int. Cl.[2] ..... F42D 1/00

[58] Field of Search ..... 102/20, 21, 24; 166/63, 166/299, 300, 311

[56] References Cited

UNITED STATES PATENTS 3,763,781 10/1973 Halley, Jr. ..... 102/21

*Primary Examiner*—Verlin R. Pendegrass
*Attorney, Agent, or Firm*—Paul M. Denk

[57] ABSTRACT

Controlled fracturing and loosening of geological formations with energy derived from the reaction of a specially shaped charge of alkali metal with water.

5 Claims, 9 Drawing Figures

METHOD FOR IN SITU ASSEMBLY OF CHARGE FOR CONTROLLED SHOOTING OF WELLS

CROSS REFERENCE TO RELATED APPLICATION

The subject matter of this application is related to the subject matter, and comprises a continuation-in-part application of my previous application having Ser. No. 056,438, filed on July 20, 1970, and now U.S. Pat. No. 3,763,781, and owned by a common assignee.

BACKGROUND OF THE INVENTION

This invention relates to the controlled fracturing and loosening of geological formations, such as those surrounding the bore hole of a well, as frequently done to initiate or to improve petroleum production from a drilled formation, an operation known in the art as "shooting" the well, and the function of which is to provide an escape path to the bore hole for bodies of petroleum which are entrapped in the geological formation.

Heretofore, oil wells have been "shot" with nitroglycerine, which must be transported from the site of use. Such transportation is hazardous, not only to the occupants of the vehicle which transports the nitroglycerine but also to the other users of the roads, highways and fields over which such transportation must take place. More over, the handling of nitroglycerine at the site of use, as well as the onsite operations of charging containers (so called "torpedos") with it, emplacing the torpedos at the proper elevation in the bore hole (more often than not under water), and finally setting and emplacing at least one "time bomb" to detonate the nitroglycerine charges, involve a greater degree of hazard, albeit to fewer people, than does the transportation thereof to the well site. Despite the exceptionally high degree to care exercised by skilled well shooters, more than a few of them have lost their lives or limbs, or have been maimed for life in the course of such operations.

It is therefore the object of the present invention to minimize the hazard involved in shooting wells, providing means for providing on-site assembly of various components that are useful for enhancing petroleum production from a well, and which can be handled relatively free of any hazard which, as previously described, is always present when operating with nitroglycerine charges, or the like.

For some years, many skilled oil well shooters have recognized that the shock waves generated by the detonation of nitroglycerine with a well are not ideal for the purpose intended. There are two schools of thought — frequently over-lapping on the subject. One school holds that the shock waves generated by nitroglycerine have a frequency too high for optimum results. The other school holds that the duration (life to decay) of shock waves generated by nitroglycerine is too short for optimum results. Most experienced shooters appear to agree, however, that it is virtually impossible to accomplish with nitroglycerine an effective shot while the bore hole is occupied, at least at the shooting elevation, with acid put there in the course of an unsuccessful acidizing treatment; and that too often a nitroglycerine shot collapses open-ended tubing in the well.

Accordingly, it is another object of the invention to obviate the aforesaid objections to shooting wells with nitorglycerine.

These and other objects of the invention are achieved by the utilization of the reaction of an Alkali metal (sodium, potassium, cesium, rubidium, lithium) with water as the source of energy for shooting wells, and which charges can be prepared for immediate use at the site of the well.

The invention evolved from experience with an oil well about 3,200 feet deep which had previously been a fair producer of oil and a good producer of gas, but whose production of gas had declined to near zero, and whose oil production had declined to about one barrel per day. The well had been shot with nitroglycerine and had been acidized, without noticeable improvement in production. The well was filled with liquid to the level of about 2,500 feet below ground, and was about to be abandoned when, at my suggestion, three pounds of sodium (in two oil coated pieces) were dropped into it. Production of copious natural gas was resumed immediately, and the production of oil increased to about 69 barrels per day.

Unlike nitroglycerine, and other "high" explosives, the Alkali metals do not detonate when subjected to impact, heat or flame; but do detonate upon contact with water (usually present in more or less degree in any oil well to be shot) or with acid (frequently present). Such detonation is attanded by the release of a mol of hydrogen for each mol of water that reacts with a mol of the Alkali metal to produce the hydroxide of the metal, and thereby release a quantum of energy equal to the heat generated by the exothermic reaction. For instance, with sodium, which is the most readily and economically available of the Alkali metals, the reaction with water occurs, albeit at a rate less than detonation, when the metal is exposed to atmospheric humidity, but the customary preventative is to handle and transport sodium in a blanket of nitrogen or other non-reactive gas such as argon or helium, or to coat it with oil or grease.

The hydrogen released by the reaction of sodium with water or acid, if in the presence of air or other available oxygen, will, if ignited, produce more water; and if so ignited in contact with carbonaceous material, such as petroleum, will produce carbon dioxide. Carbon dioxide dissolved or entrained in water constitutes a composition which has been reported to increase more than a hundred times, the solubility of such calcerious materials as argonite and calcite over their solubility in cold water at about forty times their solubility in hot water; and if sulphuric acid is present, or the petroleum is sulfurous, as when produced from calcerious formations containing anhydrite or gypsum, the concurrent reactions may yield hyposulfite, which is a well-known solvent for anhydrite and gypsum. Consequently, when sodium is employed as the explosive to loosen oil-bearing calcerious formations, there is an inherent advantage of providing, in situ, a secondary result of the same kind as, albeit lesser in degree than, that achieved by conventional acidizing of wells. However, aside from safety, the major operating advantage of shooting wells with sodium or other Alkali metals is attributable to the character and duration of the shock waves which emanate from their reaction with water.

The shock waves which emanate from the reaction of sodium with water appear, from surface sensation, to have a substantially lesser frequency than those produced by the detonation of nitroglycerine; and the duration of the wave action appears to be about 50 times as long as those produced by the detonation of nitroglycerine. This difference in the character and duration of the shock waves appears to have a markedly different effect on the geological formation being shot. Nitroglycerine tends to locally shatter the formation, whereas the sodium-water reaction appears to loosen it over a much greater radius. These contrasting effects may be attributable to the fact that an entire charge of nitroglycerine detonates instantaneously, whereas the reaction between sodium and water, depending, as it does, upon the magnitude of the area of the sodium charge exposed at any increment of time to the water, is more time-consuming and more readily controlled by varying the surface area of a body of metallic sodium which will be exposed to water.

EXAMPLE 1

The simplest embodiment of the invention is to drop the desired quantity of solid state metallic sodium down the bore hole of a well. If, as is usually the case, there is a body of residual water in the bottom of the bore hole, the explosive reaction will occur upon contact of the sodium with the residual water. However, such a procedure is less efficient and less controllable than is usually desired. For instance, some of the available energy of the sodium is lost, en route down the hole, by reaction with the water vapor contained in the air or other gas which occupies the bore hole above the liquid level therein. Again, when the falling body of solid sodium meets the body of residual water, the sodium will sink only to the extent required to absorb the kinetic energy of the falling body, then the body of sodium will return to the surface of the water and float there with part only of its surface in reactive contact with part only of its surface in reactive contact with the body of water. Hence, the reaction between the sodium and the water proceeds at a slower rate than if the entire surface of the sodium had been in contact with water. Moreover, if there is oil in the bottom of the bore hole the oil will be floating on the water so that the charge of sodium must pass through the supernatant oil before reaching the water; and hence the charge of sodium may become coated with oil, with the result that the desired sodium-water reaction is retarded at the oil coated surfaces.

In this and other examples, if the bottom of the bore hole does not initially contain residual water — or contains an insufficient amount of water — the desired amount of water must be introduced from an external source, and such is preferably done before the sodium charge is emplaced.

EXAMPLE 2

The desired charge of solid metallic sodium, such as one or more sodium "brick" of commerce, is packaged in a fluid-tight container, and equipped with a sinker of sufficient mass to prevent the package from floating on the water in the bottom of the bore hole. The package is then lowered on a cable into the well to a depth at least sufficient that the packaged sodium is submerged in water, and positioned at the desired elevation in the hole. Thereupon, the package is ruptured by any suitable means which permits the container to be filled with water.

Such rupturing may be achieved with a variety of means, such as by energizing an electric blasting cap within the package, or by utilizing a bag made of slowly water soluble plastic film (e.g., polyalkylene ether) as the package, or by pre-perforating a water insoluble container and sealing the perforations with water-soluble, or at least water-softenable, sealing material such as polyvinyl alcohol, methyl cellulose, sodium silicate, any water soluble silane material, or any water-soluble gum. When the seals dissolve, the water can then move in. Preferably top and bottom seals are used, and when both seals are made of the same material, their release will be substantially simultaneous, but if made of different materials, the top seal is preferably the weaker to assure its release to permit the entry of the modicum of water required to initiate the sodium reaction, whereupon the package will be blown to bits, and the reaction will proceed unabated. The package can be anything from a plastic bag to a tube or canister made of paperboard, plastic or thin gauge metal.

EXAMPLE 3

An illustrative embodiment of tangible apparatus, accessories and supplies for practicing the process of the invention is shown in the accompanying drawings, in which.

Figures 1, 2:
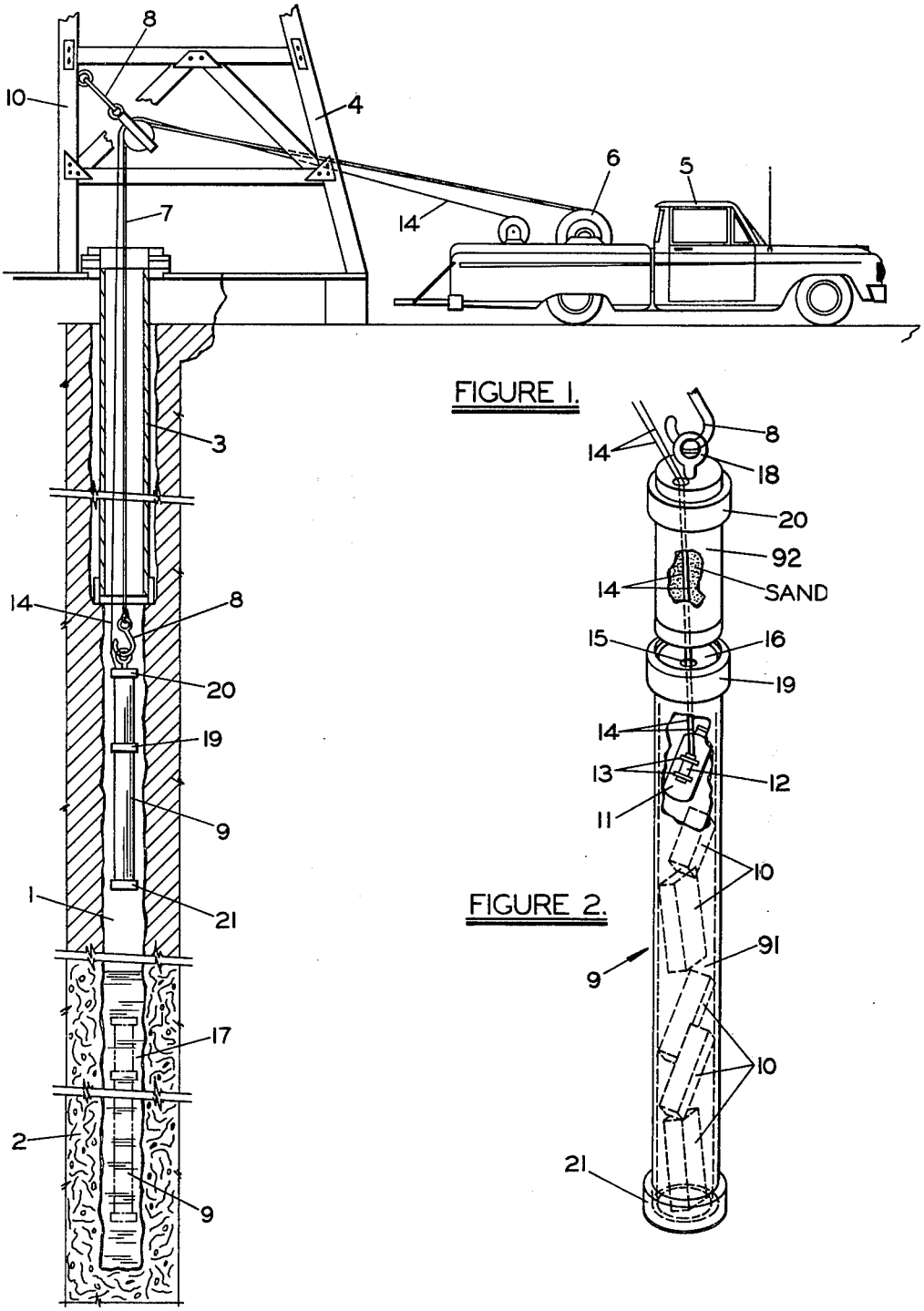
FIG. 1 is a view in side elevation, partly in vertical section, showing a suitable apparatus and accessories for emplacing packaged sodium in an oil well to be shot.
FIG. 2 is an exploded perspective view of the package of sodium, sinker and accessories shown in FIG. 1.

In FIG. 1, there is shown the rigging which typifies that used in the customary shooting of oil wells with nitroglycerine, as modified to accommodate shooting of such wells in accordance with the present invention.

As shown in FIG. 1, a drill hole 1 leads from the earth's surface to the oil-bearing stratum 2 of a subterranean geological formation. The upper end of the bore hole 1 has been provided with a casing 3, above which there is erected a derrick 4, or other comparable superstructure.

Normally, a vehicle 5, equipped with a cable reel 6 is provided with a measuring device to indicate the depth of the free end of the cable at any increment of time during the operating of lowering the blasting charge into the bore hole 1.

From the reel 6, there extends a cable 7 having a hook 8 at the free end thereof, onto which an explosive-containing-package 9 may be hung for lowering to the chosen depth in the bore hole. The apparatus thus far described is shown merely to illustrate the environment, and forms no part of the present invention.

As the objective is to increase the flow of oil from the stratum 2 into the bore hole 1, the explosive-containing-package 9 is required to be placed in that stratum, but not necessarily at the bottom of the bore hole. However, where it is desired to place the explosive charge in spaced relation from the bottom of the bore hole, various expedients are known in the art for so doing, and may be employed in connection with the practice of the present invention. Likewise, when that package 9 has been emplaced at the desired location, it may, if desired, be covered by any suitable "stemming", "tamping", or confining material, in accordance with the prior practice of shooting wells.

One form of explosive-containing-package, suitable for use in accordance with the present invention, is shown in FIG. 2, and, in the embodiment shown, comprises two tubular compartments 91 and 92 which, in FIG. 2, are, in the interest of clarity, shown spaced apart, but, in use, will be understood to be coupled together in tandem. The lower compartment 91 contains the requisite charge of solid metallic sodium, for example, about fifty pounds thereof. As shown in the drawing, the explosive charge consists of five sodium "bricks" (castings) 10, and a container, such as a pint glass bottle 11, of water. A common blasting cap 12 is attached to the bottle 11, as by means of strips of tape 13, and a pair of wires 14 extend from the cap 12 through a self-sealing grommet 15 in the end wall 16 of tube 91, and from thence upward through the bottom wall of tube 92 through the upper end thereof (which may be open) to a source of electrical energy, such as the electrical system within which vehicle 5 is equipped. From the upper end of tube 92, the wires 14, which are insulated, may be trained over a pulley to a second reel located on vehicle 5. Alternatively, a source of electrical energy, such as a dry cell battery, may be provided within tube 91, and equipped with a timing device set with a sufficient time delay to postpone the energization of blasting cap 12 until after the explosive charge has been emplaced, as desired, in the oil-bearing stratum 2.

Normally, the tube 91 is charged with the bricks 10, bottle of water 11, and blasting cap 12, before top wall 16 is put in place to hermetically seal the contents of tube 91, but with the wires 14 extending through wall 16 in hermetically sealed relationship by means of grommet 15.

The upper tube 92 not only serves as a conduit for wires 14, but as a container for materials which constitute the sinker of the compartmented package, and may be charged with a sufficient quantity of sand, rock salt, or metal filings or turnings to make the composite package 9 sink into the body of water 17 which reposes in the lower end of the bore hole, either naturally or by previous deliberate introduction.

As shown in FIG. 2, the upper end of compartment 92 is equipped with a ring 18 to be engaged by hook 8 on the end of cable 7, and the upper end of compartment 91 is coupled to the lower end of compartment 92 by any suitable means, such as a collar 19, which is in load-sustaining mechanical connection with both compartment 91 and and compartment 92. Such connection can be achieved by threading the collar onto the adjacent ends of tubes 91 and 92, or by welding or heat sealing the same thereto, or in any other suitable way, so that the two compartments 91 may be handled unitarily.

In order to prevent puncturing or other damage to the compartments 91 and 92 in the course of their travel down the bore hole, additional collars 20 and 21 are preferably provided at the upper and lower ends of the composite package.

Once the composite package 9 is emplaced at the proper position in the oil-bearing stratum 2, the hook 8 is released from ring 18 and withdrawn from the hole without disturbing wires 14; and thereafter the wires 14 may be energized to initiate the blasting cap which breaks the bottle 11, and spills the water contained therein onto the sodium bricks 10, thereby creating a minor explosion which ruptures compartment 91 and permits the bricks 10 to react with the surrounding water 17 and thereby creating a major explosion to fracture, disintegrate, and otherwise "open up" the oil-bearing stratum 2.

Figure 3:
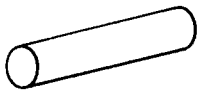
FIGS. 3, 4 and 5 are, respectively, perspective views of three commercially available forms of sodium "bricks" with which the package of FIG. 2 may be charged.
Figure 4:
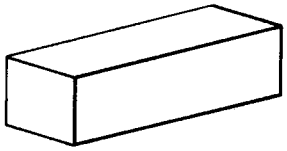
Figure 5:
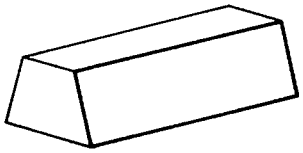
Figure 6:
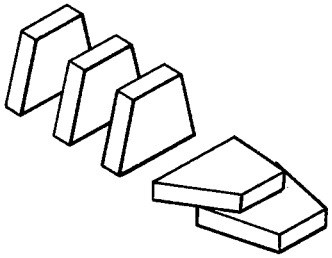
FIG. 6 is a perspective view of slices cut from the sodium "brick" shown in FIG. 5.

The sodium bricks 10 may take any of a variety of forms, three commercially available ones being shown in FIGS. 3, 4, and 5 respectively: that shown in FIG. 3 being substantially cylindrical; that shown in FIG. 5 being, geometrically considered, a right prism whose bases are isosceles trapezoids. The cross-section of the body of metallic sodium affects the speed of the desired reaction by the theorem that the greater the exposed surface of the sodium body, the faster the reaction will be. Accordingly, bricks of the shape shown in FIG. 3 react at a slower rate than that shown in FIG. 5, if all are of the same weight. To speed the reaction, however, such bricks may be sliced, as shown in FIG. 6 for the prism shown in FIG. 5, thereby to increase, manifold, the surface of sodium which will be immediately exposed to surrounding water. Accordingly, the speed of the explosion may be varied by charging compartment 91 with different shapes and sizes of bricks or slices thereof; or under circumstances deemed to require the character of explosion heretofore produced by nitroglycerine, the sodium may be disintegrated into pellets or particles substantially smaller than the slices shown in FIG. 6.

On the other hand, as the reaction proceeds between water and a brick, or slices or a brick, of sodium, the exposed surface area of any individual sodium brick, slices, pellet or particle, progressively diminishes. This is desirable under certain well conditions, but under other well conditions, the reverse is desirable, to wit: that the rate of reaction progressively increase. The latter may be accomplished by cannelating the bricks, or slices, as by drilling them or by casting the bricks about removable cores to provide open canals therein, thereon or therethrough; or by casting the bricks under inert gasifying conditions which makes them porous even to the degree which causes the bricks to disintegrate in the course of their reaction with water. The provision of such canals, either internally or externally, increases the initial surface which can be exposed to water, but also, in the case of internal canals, as the reaction proceeds, the exposed surface area increases progressively during the reaction because the consumption of sodium is from the inside of the canal outward thereof. Such canals may extend either longitudinally or crosswise of the sodium brick, but in situations where the bricks are arranged within their container, as shown in FIG. 2, i.e., substantially on end, it is preferable that internal canals extend in the radial direction of the brick rather than the axial direction thereof because if the holes extend axially, the main thrust of the explosion will be directed more or less vertically (up or down) which, in the case of shooting oil wells, i.e., substantially on end, it is preferable that internal canals extend in the radial direction of the brick rather than the axial direction thereof because if the holes extend axially, the mainthrust of the explosion will be directed more or less vertically (up or down) which, in the case of shooting oil wells, is seldom desirable, and at least less desirable than for the main thrust of the explosion to be directed more horizontally.

Figure 8:
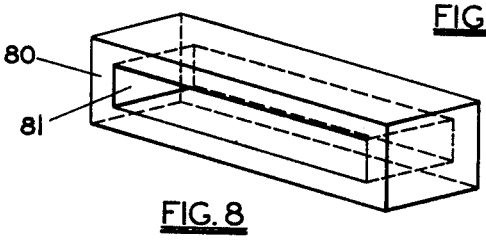
FIG. 8 is a perspective view of a form of cannelated sodium "brick" designed to maintain a substantially constant reaction rate.
Figure 7:
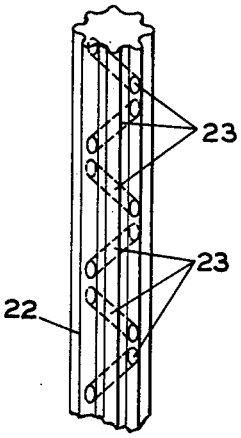
FIG. 7 is a perspective view of a cannelated sodium "brick" suitable for use in accordance with the invention.

One way to increase the initial thrust of the explosion and to maintain a high degree of thrust albeit at a sacrifice of duration for a given mass (weight) is to cannelate a brick of sodium both interiorly and exteriorly as shown in FIG. 7, where a series of external canals 22 is formed by fluting or corrugating the external surface, while a series of radially extending holes 23 form on the interior thereof. As shown, the holes 23 are spaced apart axially a distance approximately equal to the outside diameter of the bricks shown in FIG. 7, and are oriented in staggered relationship at an angle of about 60° from each other, so that when such a brick is positioned within a package such as 9, the holes 23 are shown with smooth bores as would be formed by drilling, but, if formed by coring the casting, can be fluted after the fashion of the exterior surface 22. While the holes 23 are shown with both ends open, they can, if desired, be made with a closed end. When the conditions dictate the desirability of maintaining a substantially constant rate of reaction from initiation to complete decay, the sodium brick may be internally cannelated to make its internally exposed surface area geometrically similar to, but smaller than, its externally exposed surface, i.e., with substantially constant wall thickness. One form of such treatment is shown in FIG. 8, where a brick 80 of external shape and size the same as that shown in FIG. 4, is cored to provide an internal canal 81. With such a cannelated brick, the rate of reaction within the canal increases while the rate of reaction at the exterior surface is decreasing. Hence the two compensate for each other, and the composite evolution of hydrogen is maintained substantially constant. Of course, the same sort of treatment can be applied to bricks of other basic shapes.

Thus, by appropriately mixing the shapes and sizes of sodium bodies in a given package such as 9, the blasting characteristics of the package may be varied widely.

Figure 9:
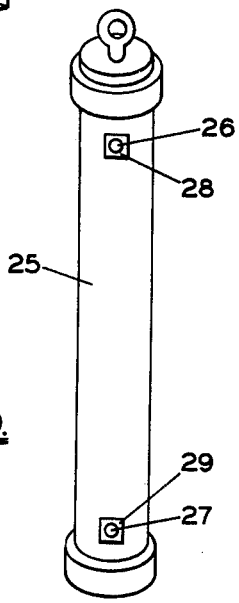
FIG. 9 is a perspective view of another form of package which maybe used as an alternative to that shown in FIG. 2, in accordance with Example 2.

As an alternative to the composite package 9 shown in FIGS. 1 and 2, a unitary package, such as that referred to in Example 2 and shown in FIG. 9, may be utilized. In FIG. 9, a tubular container 25, which may be a conventional helically or convolutely wound paper-bound tube which is constructed to be fluid-tight, and which has sufficient strength for the purpose, is charged with the chosen weight, sizes and shapes of solid metallic sodium bodies, and sealed with appropriate fluid-tight closures at each end. In the bottom of such a tube may be placed an appropriate sinker. The container shown in FIG. 9 is characterized by the feature that prior to being charged it is perforated with a small hole 26 near the top thereof, and with a larger hole 27 near the bottom thereof. The holes 26 and 27 are, before or after, but preferably after being charged with sodium, sealed by any suitable patch 28 and 29, respectively, of water soluble or water softenable material, such as methyl cellulose, polyvinyl alchol, or others previously mentioned. When such a package is emplaced within the water near the bottom of a bore hole, the patches 28 and 29 will gradually soften, and permit wth water to gain access to the sodium through the lower hole 27, thereby initiating a reaction which ruptures the tube 25 and exposes the entire charge of sodium to the action of the surrounding water. Hence, no blasting cap or other such instrumentality which is surface-controlled is necessary as control of the hiatus between emplacing the package and the initiation of its explosion is achieved by choice of a water-soluble or -softenable patch material having the desired sealing life under water.

From the foregoing description, those skilled in the art will readily understand that the invention not only achieves its aforementioned objects and provides a new use for sodium, but provides an explosive shock which, in comparison with the heretofore employed nitroglycerine, is less violent but more enduring, and more far-reaching in effect. Moreover, a given mass (weight) of sodium, when reacted with water releases more than twice the energy released by exploding the same weight of nitroglycerine, and withal the rate of reaction between water and sodium is readily regulatable by modifying the exposed surface characteristics of a solid body thereof as hereinbefore disclosed. Indeed, the invention not only provides means for increasing the initial reactivity of a body of sodium, but provides means for controlling the reactivity rate as the sodium is consumed. Thus, the geologist and the well shooter are provided a choice of explosive wave characteristics, and depending upon their judgement as to what is best to produce the desired result in a given geological formation, may, with comminuted or pelleted sodium particles achieve a shock comparable to that produced by nitroglycerine; or with larger smooth surfaced bodies; achieve a shock of long duration with diminishing intensity; or with their surface cannelated, increase the initiallintensity; or with their interior surface vented and the exterior surface coated with a water immiscible substance, to progressively increase the intensity; or any chosen combination of these.

Moreover, the blasting with sodium, as distinguished from nitroglycerine, makes it possible and practical to simultaneously introduce and release a charge of acid, surfactant, or other conventional well-treating compound.

While several embodiments of the invention have been disclosed for the purpose of illustrating its versatility, it is not intended that the invention be limited to the details disclosed because the ramifications and variations of the invention are legion, and will readily appear to a reader skilled in the art, but consistent with the required concision, have been omitted herein.

Having thus described the invention, what is claimed and desired to be secured by Letters Patent is:

1. In the method for in situ assembly of charge for controlled shooting of wells which are at least partially occupied by water, the process of increasing flow comprising, providing a charge of solid state alkali metal having a surface area formed, shaped and capable of providing a controlled reaction when exposed to the water, hermetically sealing the charge within a container to prevent exposure of the charge to moisture prior to initiating the controlled reaction, weighting the containerized charge to insure its sinking into the water occupied well, depositing the containerized charge into the well, and opening the container to react the charge at a sustained rate with the surrounding water to improve petroleum production from the drilled well formation.

2. The process of claim 1 wherein said charge is solid state of sodium.

3. The process of claim 2 wherein said solid state sodium is formed having a cannelated surface.

4. The process of claim 2 wherein said solid state sodium is formed having a preformed canal therein.

5. The process of claim 1 including regulating the rate of reaction between water and the charge of alkali metal which comprises, modifying the surface area of said charge by increasing its surface area to accelerate the reaction and by decreasing its surface area to decelerate the reaction.

* * * * *